US006634182B2

(12) United States Patent
Ichikawa et al.

(10) Patent No.: US 6,634,182 B2
(45) **Date of Patent: *Oct. 21, 2003**

(54) AMMONIA REFRIGERATOR

(75) Inventors: Yoshifumi Ichikawa, Shizuoka (JP); Makoto Ohtahara, Shimizu (JP)

(73) Assignees: Hitachi, Ltd., Tokyo (JP); Trustee for the benefit of Hitachi Air Conditioning Systems Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/040,451

(22) Filed: Jan. 9, 2002

(65) Prior Publication Data

US 2002/0108392 A1 Aug. 15, 2002

Related U.S. Application Data

(63) Continuation-in-part of application No. 09/526,563, filed on Mar. 16, 2000, now Pat. No. 6,349,558.

(30) Foreign Application Priority Data

Sep. 17, 1999 (JP) ..... 11-263235

(51) Int. Cl.[7] ..... F25D 17/02
(52) U.S. Cl. ..... 62/434; 62/430; 165/164
(58) Field of Search ..... 62/430, 434, 436, 62/259.1

(56) References Cited

U.S. PATENT DOCUMENTS

| | | | | |
|---|---|---|---|---|
| 2,246,401 A | | 10/1941 | Waterfill | |
| 3,992,168 A | | 11/1976 | Toyama | |
| 4,276,927 A | | 7/1981 | Foust | |
| 4,344,296 A | | 8/1982 | Staples | |
| 4,372,375 A | * | 2/1983 | Bond | 165/70 |
| 4,509,344 A | | 4/1985 | Ludwinsen et al. | |
| 4,537,046 A | | 8/1985 | Fujiyama | |
| 4,700,548 A | | 10/1987 | Roche | |
| 4,827,735 A | | 5/1989 | Foley | |
| 4,831,830 A | | 5/1989 | Swenson | |
| 5,261,799 A | | 11/1993 | Laskaris | |
| 5,350,275 A | | 9/1994 | Ishimaru | |
| 5,388,420 A | | 2/1995 | Yoshida | |
| 5,598,716 A | | 2/1997 | Tanaka | |
| 5,671,607 A | | 9/1997 | Clemens et al. | |
| 5,894,739 A | | 4/1999 | Temos | |
| 5,916,249 A | | 6/1999 | Baker | |
| 6,253,566 B1 | | 7/2001 | Ichikawa et al. | |
| 6,349,558 B1 | * | 2/2002 | Ichikawa et al. | 62/434 |

FOREIGN PATENT DOCUMENTS

| | | | |
|---|---|---|---|
| EP | 348771 | | 1/1990 |
| GB | 2173886 | | 10/1986 |
| JP | 09138024 A | * | 5/1997 |
| JP | 10112949 | | 4/1998 |
| JP | 10141226 | | 5/1998 |
| JP | 10274447 | | 10/1998 |
| WO | 9940383 | | 8/1999 |

* cited by examiner

*Primary Examiner*—Chen Wen Jiang
(74) *Attorney, Agent, or Firm*—Antonelli, Terry, Stout, & Kraus, LLP

(57) ABSTRACT

A highly efficient and compact ammonia refrigerator, whose safety is further improved, is obtained. The ammonia refrigerator uses ammonia as refrigerant and has an ammonia refrigerating cycle in which a compressor, a condenser, an expansion valve, and an evaporator are connected through piping. The refrigerator comprises a casing in which the compressor and a motor for driving the compressor are accommodated and the refrigerant flows, a stator winding of the motor made of an aluminum wire, and a brine cooled by the refrigerant which is compressed in the casing and then evaporated in the evaporator.

7 Claims, 2 Drawing Sheets

AMMONIA REFRIGERATOR

CROSS REFERENCE TO RELATED APPLICATION

This application is a continuation-in-part application of U.S. Ser. No. 09/526,563, filed Mar. 16, 2000 now U.S. Pat. No. 6,349,558.

BACKGROUND OF THE INVENTION

The present invention relates to a refrigerator which uses ammonia as the refrigerant in order to cope with environmental problems such as ozone layer destruction, global warming, or increase of carbon dioxide, and it is particularly suitable for a refrigerator such as a showcase, a freezer, an automatic vending machine, a cooling storage unit and an ice making machine, and for an extremely low temperature refrigerator or the like.

In case of a compressor of the refrigerating cycle using ammonia as the refrigerant, an open type where a compressor and a motor are connected through a shaft is employed, or a stator of the motor is separated from a rotor by a wall called a can, so that contact between the ammonia refrigerant and the winding of the stator may be prevented.

The open type compressor, as it is directly connected to the motor by the connecting device outside the compressor, is large-sized as a unit, and a work of centering at the installation site is necessary. Furthermore, since a shaft seal unit is required on the compressor side, there has been a fear of leakage of the refrigerant and refrigerator oil from seal portions of the shaft seal unit, and it has also been necessary to attain improvement from the viewpoint of safety.

On the other hand, in case of using the can, the structure is complex, and further, the efficiency is lowered. In view of this, it has been known that a closed type compressor is employed and the winding of a stator is coated with aluminum resistant to ammonia as disclosed by JP-A-10-141226, and that a "cage type" winding forming a rotor is made of an aluminum wire as disclosed by JP-A-10-112949.

Furthermore, JP-A-10-274447 discloses an ammonia refrigerant refrigerator, an auxiliary fluid is used so that the electrical insulation performance may be improved and the efficiency as a refrigerator may be improved.

In the units described in the above publications, safety, corrosion or the like due to the leakage in the compressor or the compression process when using ammonia refrigerant is considered, but as an ammonia refrigerator, it is also necessary to attain downsizing, highly efficient operation, and improvement of safety, not only as a mere compressive mechanical portion but also as an entire refrigerator.

SUMMARY OF THE INVENTION

It is an object of the present invention to provide a highly efficient and compact ammonia refrigerator whose safety is further improved.

Furthermore, another object of the invention is to simplify a refrigerating cycle and decrease the amount of filling of refrigerant, and to enhance the refrigerating ability while decreasing the consumption of electric power or the like, thereby realizing energy saving.

To attain the above objects, the invention provides an ammonia refrigerator using ammonia as a refrigerant and having an ammonia refrigerating cycle in which a compressor, a condenser, an expansion valve, and an evaporator are connected through piping. The refrigerator comprises a casing which accommodates a compressor and an electric motor for driving the compressor and through which the refrigerant flows, a stator winding of the motor made of an aluminum wire, and a brine to be cooled by the refrigerant which is compressed in the casing and then evaporated in the evaporator.

In the ammonia refrigerating cycle, the stator winding of the motor is made of an aluminum wire, and even without a can, there is no fear of corrosion caused by ammonia, and the structure can be simplified. Also, the efficiency is not lowered. Furthermore, air conditioning, refrigerating or the like is performed through the brine cooled by the ammonia refrigerant, and therefore, safety is further improved in a portion or area to be air-conditioned and a portion or area to be refrigerated, and the amount of filling of the refrigerant can also be reduced.

In the above arrangement, it is preferable that the evaporator is a plate type heat exchanger having a plurality of plates piled, and that an inverter drive unit for controlling the capacity of the compressor is provided.

Further, the invention provides an ammonia refrigerator using ammonia as a refrigerant and having a refrigerating cycle in which a compressor, a condenser, an expansion valve, and an evaporator are connected through piping and which has brine cooled by the refrigerant, wherein the winding of a motor for driving the compressor is made of aluminum wires, the brine is cooled by the ammonia which is compressed in the compressor and then evaporated in the evaporator, during an ice heat storage operation, the brine is supplied to a heat storage tank to freeze water therein, and the cold water cooled in the heat storage tank is moved by a cold water pump.

In the ammonia refrigerating cycle, as the winding of the motor is made of aluminum wires, there is no fear of corrosion caused by ammonia, the structure can be simplified, and the efficiency is not deteriorated. Further, the brine is cooled by the ammonia refrigerant, and water is cooled by the brine and moved by a cold water pump to perform air conditioning in a room. Accordingly, the ammonia does not leak into the room, and the safety is further improved. Moreover, by performing the heat storage operation with the electric power at night, demands of the electric power are leveled, and the refrigerator is suitable for coping with the environmental problems such as ozone layer destruction, global warming, or increase of carbon dioxide.

Furthermore, the invention provides an ammonia refrigerator using ammonia as a refrigerant and having a heat source machine in which a compressor, a condenser, an expansion valve, and an evaporator are connected through piping and which has brine cooled by the refrigerant. The refrigerator comprises a compressor in which the winding of a motor is made of aluminum wires, a heat storage tank to which the brine is supplied, and a cold water pump which moves cold water cooled in the heat storage tank.

Furthermore, the invention provides an ammonia refrigerator using ammonia as a refrigerant and having a refrigerating cycle in which a compressor, a condenser, an expansion valve, and an evaporator are connected through piping and which has brine cooled by the refrigerant. The refrigerator comprises a compressor in which the winding of a motor is made of aluminum wires, a heat storage tank to which the brine is supplied, a cold water pump which moves into a room cold water cooled in the heat storage tank, a brine/water heat exchanger for performing heat exchange between the cold water which has carried out air conditioning in the room and the brine, and a three-way valve which mixes pre-cooled water cooled in the brine/water heat exchanger and cold water cooled in the heat storage tank.

The cold water cooled by the brine in the heat storage tank is moved into the room, and the cold water by which the air conditioning has been carried out in the room is cooled in the brine/water heat exchanger to be pre-cooled water. The pre-cooled water is mixed with the cold water cooled in the heat storage tank. Accordingly, the structure is simple, the cold water supplied into the room has a constant temperature, and with no surplus ability, the air conditioning can highly efficiently be performed. Consequently, the amount of filling of the refrigerant can be decreased, and the performance of refrigeration is increased while the consumption of electric power is reduced.

Furthermore, the invention provides an ammonia refrigerator using ammonia as a refrigerant and having a refrigerating cycle in which a compressor, a condenser, an expansion valve, and an evaporator are connected through piping and which has brine cooled by the refrigerant. In the refrigerator, the winding of a motor for driving a compressor is made of aluminum wires, in case of an ice heat storage operation, the brine cooled by the refrigerating cycle is supplied to a heat storage tank to make ice, in case of a cooling operation, the cold water returning from the inside of a room is pre-cooled by the brine and is divided, and one of the divided water and the other which is further cooled in the heat storage tank are mixed and moved into the room.

In the above arrangement, the evaporator preferably comprises a plate type heat exchanger having a plurality of plates piled.

DESCRIPTION OF THE PREFERRED EMBODIMENTS

Figure 1:
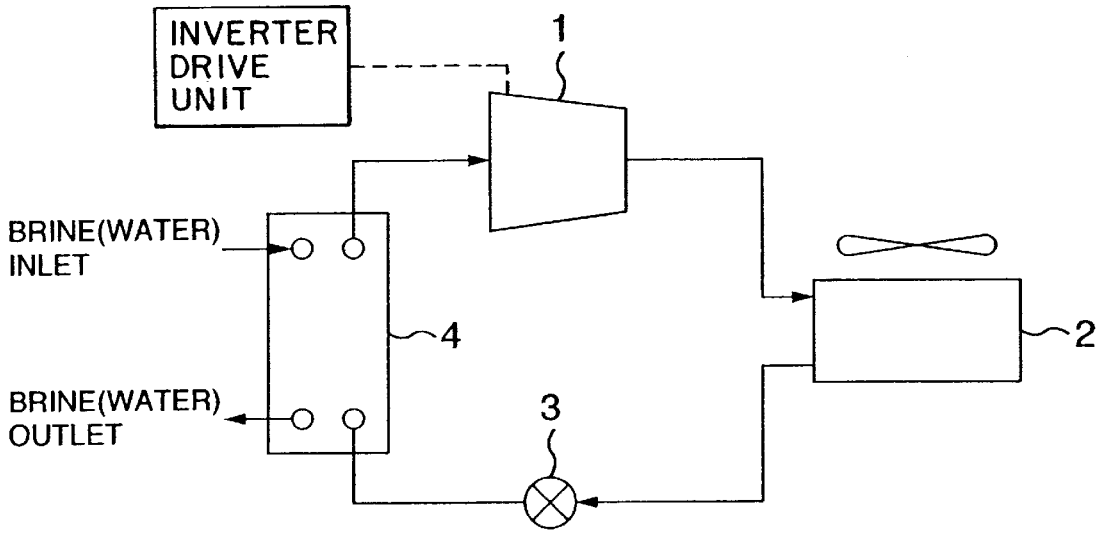
FIG. 1 is a cycle system diagram of an ammonia refrigerating cycle according to an embodiment of the invention.

An embodiment of the invention will be described below with reference to the drawings. FIG. 1 shows a cycle system diagram of an ammonia refrigerating cycle, in which a condenser 2 is shown as being of an air-cooled type, but it may be of a water-cooled type. In a compressor 1, gaseous ammonia is compressed to be a high temperature and high pressure gas, and in a condenser 2, it is cooled by cold water or air to be condensed liquid. This condensed liquid is expanded in a main expansion valve 3 to be a low pressure wet gas, and in a plate type heat exchanger 4 serving as an evaporator, it performs cooling of a brine or water which is the substance to be cooled. After that, the gas is drawn into the compressor 1.

In case of use for air conditioning, because of the characteristics of fluorocarbon 22, the refrigerating ability decreases by about 10% as compared with ammonia, and the electric power consumption per the quantity of heat for cooling is increased. This causes carbon dioxide produced when generating electric power to be also increased, which further affects the global warming.

In a refrigerator using fluoro-carbon 22 as the refrigerant, when used for air conditioning, the refrigerating ability decreases as compared with ammonia. Further, with fluorocarbon 22, the ozone layer destruction factor (ODF) and the global warming potential (GWP) are also high, and from the viewpoint of the global environment, switching to the ammonia refrigerant which is a natural refrigerant and does not affect the ozone layer destruction or the global warming is an urgent need. Also, in case of an ammonia refrigerator using the above-described open type compressor, there have been such problems that the unit becomes large-sized, that a work of centering is required at the installation field, that the refrigerant may leak from the shaft seal unit, and that maintenance work at the job site is necessary.

Figure 4:
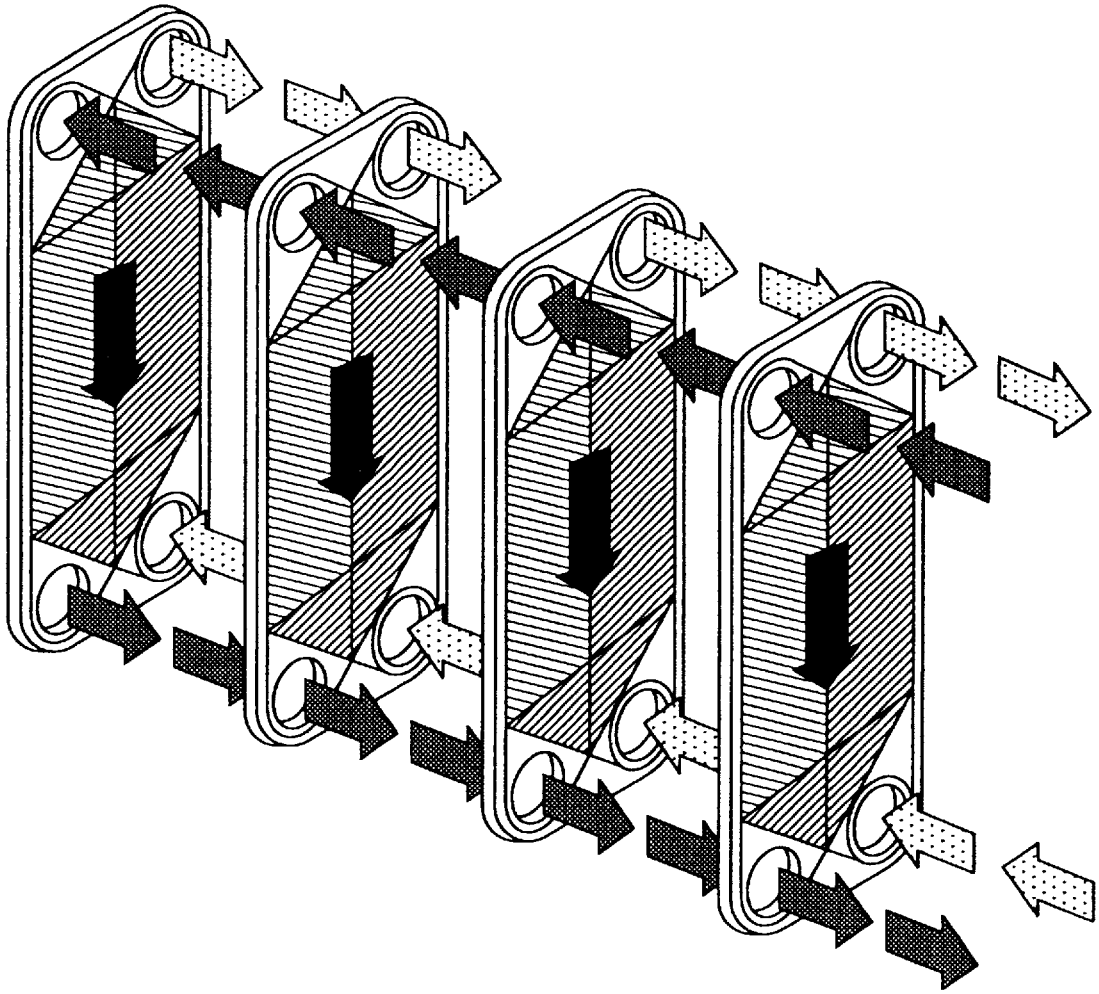
FIG. 4 is a perspective view of a plate type heat exchanger according to an embodiment of the invention.

FIG. 4 is a perspective view showing the structure of brine inlet and outlet of a plate type heat exchanger 4, and the brine flows in from the inlet at the upper portion of the plate type heat exchanger. Evaporation of the ammonia refrigerant causes the brine to be cooled while flowing from the upper portion to the lower portion, and the brine is discharged from the outlet at the lower portion in the state where the temperature is lowered.

Ammonia has a strong smell, and it is required to prevent its leakage. Then it is preferable that the compressor is of a full-closed type or a half-closed type. Further, copper and copper alloy cannot be used in heat transfer tubes and refrigerant piping, and an iron tube, an SUS (stainless) tube, or an aluminum tube may be used.

Figure 3:
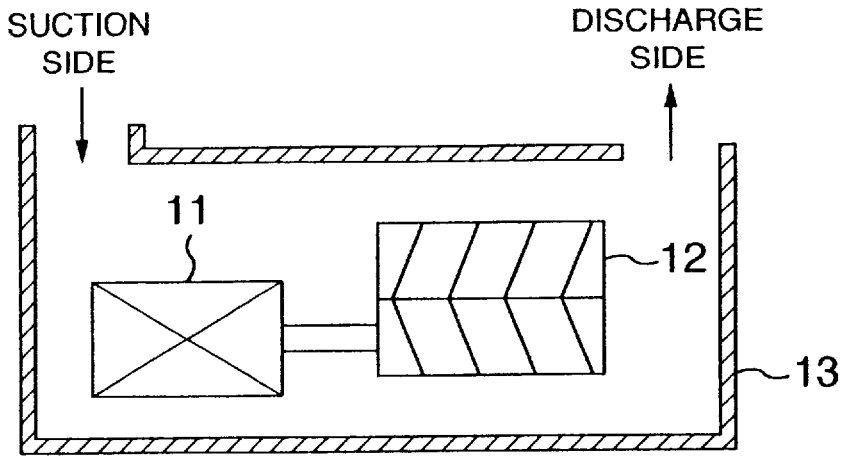
FIG. 3 is a cross sectional view showing the structure of a compressor according to an embodiment of the invention.

FIG. 3 schematically shows the compressor 1 of a full-closed or half-closed type, and the ammonia refrigerant inhaled from a suction portion is compressed by a screw rotor 12 (or a scroll) in the same casing 13, which is rotated by a stator and a rotor of an electric motor 11. The ammonia refrigerant thus compressed by the screw rotor 12 (or the scroll) is discharged from a discharge portion. A full-closed type compressor has a casing having a structure firmly closed and not easy to open while a half-closed type has a casing which is assembled by means of removable fasteners, such a bolts and nuts so as to be readily openable in the field.

The stator winding of the motor is made of an aluminum wire eliminates a fear of corrosion caused by ammonia and makes a can unnecessary, which requires a structure with compressive strength. Further, it is also possible to prevent the lowering of efficiency by about 5 to 7% caused by the can. Since the electrical resistance of an aluminum wire is 1.6 times that of a copper wire, in order to have the same or equivalent resistance, the aluminum wire must have a cross-sectional area larger by $\sqrt{1.6}$ or about 1.25 times that of copper wire. This increase in cross-section of the stator winding increases the entire size or volume of the motor. Simply estimating, increasing the cross-section of the stator winding by 1.2 to 1.4 times increases the volume of the motor by 1.2 to 1.4 times (1.25 times is preferable) and also the starting current by 1.2 to 1.4 times (1.25 times is preferable).

Moreover, since the air conditioning, refrigerating or the like is performed by using the brine cooled by the ammonia refrigerant, the safety is further improved at the portion to be air-conditioned and the portion to be refrigerated, and the amount of filling of the refrigerant can also be reduced. In addition, since employed as the evaporator is the plate type heat exchanger 4 having a plurality of plates piled, the amount of use of the refrigerant which is ammonia can also be decreased. Furthermore, by employing an inverter drive unit to control the capacity of the compressor in accordance with the flow rate of the brine, freezing in the heat exchanger due to the decrease of the amount of filling of the refrigerant can be prevented, and the reliability can be enhanced.

A refrigerator oil for lubricating bearings or the like of the compressor is preferably of a sort compatible with ammonia. For example, an ammonia PAG of a synthetic oil into which ammonia can be dissolved or a synthetic oil of the polyester family may be used, and further, a dry type system and automatic operation are preferable.

Furthermore, as an ammonia refrigerator, in the case where the refrigerator oil cannot dissolve ammonia and they are in a state of being separated into 2 phases, a low receiver type, in which the separated oil collects at the lower portion of a tank and drainage is easy, is suited from the viewpoint of oil returning.

Figure 2:
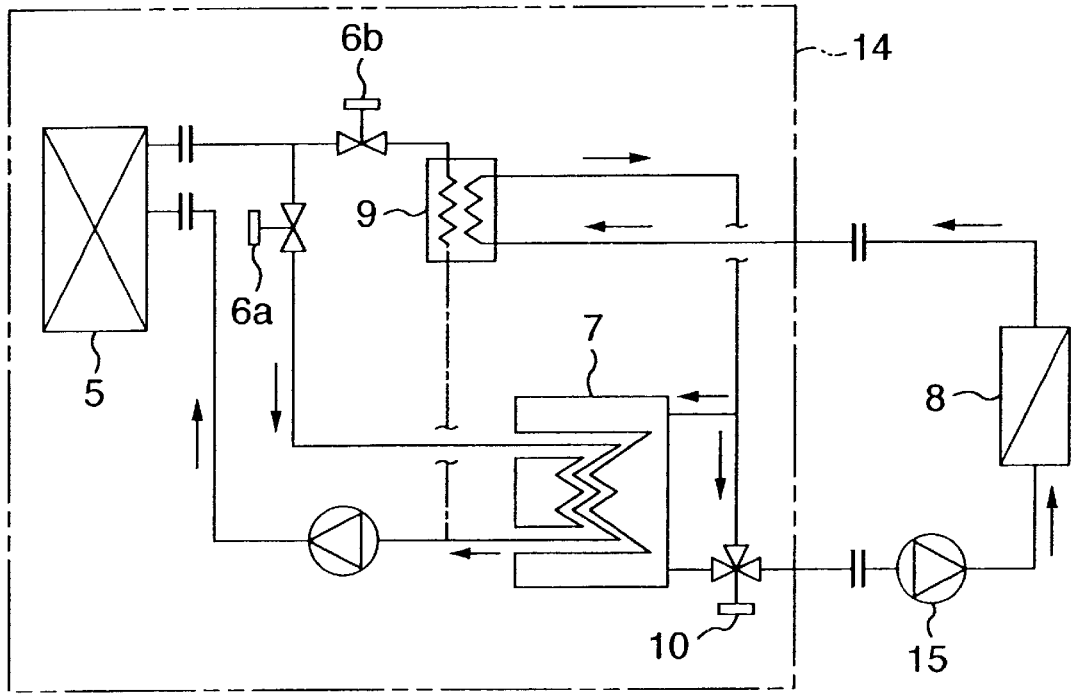
FIG. 2 is a cycle system diagram of an ice heat storage type air conditioning unit according to an embodiment of the invention.

FIG. 2 shows a cycle system diagram in the case where the refrigerator described above is used to form an ice heat storage type air conditioning unit, and a heat source machine 5 is the refrigerator having the compressor 1, the condenser 2, the expansion valve 3, and the evaporator 4, which constitute a refrigerating cycle.

In case of the ice heat storage operation at night, the heat source machine 5 is operated, and the brine cooled by the evaporator 4 in the heat source machine 5 is supplied to the ice heat storage tank 7 through a switch valve 6*a*, and in the ice heat storage tank 7, it cools the cold water in the tank. This causes the temperature of the brine to rise, and therefore, the brine is cooled again in the evaporator 4. The brine thus decreased in temperature goes to the heat storage tank 7, and it freezes the cold water in the heat storage tank 7.

In case of a cooling operation in the daytime, the cold water at 7° C., which has been cooled by the ice heat storage type air conditioning unit 14, is sent to an air conditioner 8 to perform air conditioning in the room. This causes the temperature of the cold water to rise up to 12° C., and the water returns to the ice heat storage type air conditioning unit 14. The restored cold water is precooled down to 9.5° C. in a brine/water heat exchanger 9 through heat exchange with the brine, which has been cooled in the evaporator 4 of the heat source machine 5.

The water thus pre-cooled is divided, and one goes into the heat storage tank 7 and the other goes to a three way valve 10. The pre-cooled water entering the heat storage tank 7 is subjected to heat exchange with the ice in the heat storage tank 7 so that its temperature may be lowered down to 4° C. Then, in the three way valve 10 at the outlet of the heat storage tank 7, the water cooled down to 4° C. in the heat storage tank 7 and the divided, pre-cooled water at 9.5° C. are mixed to provide cold water with a constant temperature of 7° C. The cold water at 7° C. is sent to the air conditioner 8 by a cold water pump 15 to perform air conditioning in the room.

As described above, in the refrigerator which uses ammonia as the refrigerant and has a refrigerating cycle, it is possible to improve the refrigerating ability by about 10% under the operational condition at the evaporating temperature of nearly −10° C., as compared with a refrigerator using fluoro-carbon as the refrigerant. Also in the compressor, the coefficient of performance as a refrigerator is improved by 5% in all, and a highly efficient operation is possible though the consumption of electric power is increased a little as compared with the case of a motor using a copper wire.

Further, the use of the compressor with a half closed structure makes a work of centering at the installation field or greasing up of the motor unnecessary, and leakage of the refrigerant from the shaft seal unit can be avoided. Furthermore, the unit can be made compact, and it is possible to realize the saving of maintenance and the improvement of safety.

In case of the ice heat storage type air conditioning unit, by conducting the heat storage operation at night when the ambient temperature is low, the condensing pressure decreases so that the consumption of electric power may be reduced and a highly efficient operation can be performed. Consequently, the consumption of electric power can be restrained to a level lower than that in the case where the operation is performed only in the daytime, and the effect on the global warming can further be lowered.

As having described above, according to the invention, the stator winding of the motor is made of an aluminum wire, and therefore, the structure is simplified and no lowering of the efficiency occurs. In addition, since the brine cooled by the ammonia refrigerant is used, the safety is further improved, and a highly efficient and small-sized ammonia refrigerator can be obtained.

What is claimed is:

1. An ammonia refrigerator having a refrigerating cycle, in which a compressor, a condenser, an expansion valve and an evaporator are connected through piping, and using ammonia as refrigerant, comprising:

a casing through which said ammonia refrigerant flows and which accommodates therein said compressor and an electric motor for driving said compressor, said electric motor having a stator winding made of aluminum system electric wires;

a brine for exchanging heat with said refrigerant in said evaporator; and an inverter drive unit for controlling a capacity of said compressor in accordance with a flow rate of said brine;

wherein said evaporator comprises a plate type heat exchanger, in which a plurality of plates are piled, and is so constructed that said ammonia refrigerant and said brine exchange heat with each other therein.

2. An ammonia refrigerator according to claim 1, wherein said plate type heat exchanger includes a brine inlet at an upper portion, a brine outlet at a lower portion, an ammonia refrigerant inlet at a lower portion and an ammonia refrigerant outlet at an upper portion.

3. An ammonia refrigerator having a refrigerating cycle, in which a compressor, a condenser, an expansion valve and an evaporator are connected through piping, and using ammonia as refrigerant, comprising:

a casing accommodating therein an electric motor for driving said compressor to be of a full-closed type or of a half-closed type; and a brine for exchanging heat with said refrigerant in said evaporator;

said electric motor having a stator winding made of aluminum system electric wires, a volume of said electric motor or a sectional area of said stator winding thereof is made to be larger by 1.2 to 1.4 times as compared with a volume or a sectional area of a stator winding of an electric motor of the same capacity having the stator winding made of copper wires;

wherein said evaporator comprises a plate type heat exchanger, in which a plurality of plates are piled, and is so constructed that said ammonia refrigerant and said brine exchange heat with each other therein.

4. An ammonia refrigerator according to claim 3, wherein the volume of said electric motor or the sectional area of the stator winding thereof is larger by 1.25 times as compared with the volume or the sectional area of the stator winding of the electric motor of the same capacity having the stator winding made of copper wires.

5. An ammonia refrigerator according to claim 3, wherein said plate type heat exchanger includes a brine inlet at an upper portion, a brine outlet at a lower portion, an ammonia refrigerant inlet at a lower portion and an ammonia refrigerant outlet at an upper portion.

6. An ammonia refrigerator having a refrigerating cycle, in which a compressor, a condenser, an expansion valve and an evaporator are connected through piping, and using ammonia as refrigerant, comprising:

a casing accommodating therein said compressor and an electric motor for driving said compressor to be of a full-closed type or of a half-closed type;

a brine for exchanging heat with said ammonia refrigerant in said evaporator;

an inverter drive unit for controlling a capacity of said compressor in accordance with a flow rate of said brine; and said electric motor having a stator winding made of aluminum system wires, a volume of said electric motor or a sectional area of said stator winding thereof is made to be larger by 1.2 to 1.4 times as compared with a volume or sectional area of an electric motor of the same capacity having the stator winding made of copper wires;

wherein said evaporator comprises a plate type heat exchanger, in which a plurality of plates are piled, and is so constructed that said ammonia refrigerant and said brine exchange heat with each other therein.

7. An ammonia refrigerator according to claim 6, wherein said plate type heat exchanger includes a brine inlet at an upper portion, a brine outlet at a lower portion, an ammonia refrigerant inlet at a lower portion and an ammonia refrigerant outlet at an upper portion.

* * * * *